United States Patent [19]

Rosenkaimer

[11] 4,114,787

[45] Sep. 19, 1978

[54] SHEATH FOR KNIFE WITH DEAD BLADE

[75] Inventor: Siegfried Rosenkaimer, Solingen, Fed. Rep. of Germany

[73] Assignee: Ruko of Canada Ltd., Mississauga, Canada

[21] Appl. No.: 844,161

[22] Filed: Oct. 21, 1977

[30] Foreign Application Priority Data

Oct. 28, 1976 [DE] Fed. Rep. of Germany ..... 7633910

[51] Int. Cl.[2] ..... B26B 29/02; F41B 13/04

[52] U.S. Cl. ..... 224/2 D; 224/3; 224/26 R

[58] Field of Search ..... 224/2 D, 2 B, 2 C, 2 E, 224/2 F, 3, 26 R, 26 B, 26 K, 5 R, 5 A, 5 C, 5 D, 5 E, 5 F, 5 G, 5 H, 5 L, 5 V, 5 W; 24/3 R

[56] References Cited

U.S. PATENT DOCUMENTS

| | | | |
|---|---|---|---|
| 2,117,937 | 5/1938 | Brownell | 224/2 D |
| 3,250,448 | 5/1966 | Clark | 224/2 B |
| 3,990,617 | 11/1976 | Carter | 223/3 |

FOREIGN PATENT DOCUMENTS

| | | | |
|---|---|---|---|
| 135,308 | 11/1949 | Australia | 224/2 D |
| 225,019 | 11/1924 | United Kingdom | 224/5 H |

*Primary Examiner*—Trygve M. Blix
*Assistant Examiner*—Jerold M. Forsberg
*Attorney, Agent, or Firm*—John C. Smith, Jr.

[57] ABSTRACT

A sheath for a knife with a dead blade such as a hunting knife, a Bowie knife or the like comprises a quiver, a suspender attached to the quiver and serving to push the sheath onto a body belt, and an annular retainer pivotted to the suspender, capable of being pushed over the handle of the knife and serving to secure the knife in the quiver. The suspender of the sheath in the proximity of its lower end has an edged recess extending across the width of the suspender and a tongue adjacent thereto. The tongue is bevelled and defines the lower end of the suspender. The quiver of the sheath at the rear side has an edged U-shaped bridge integral with the quiver. The bridge is arrested with its web in the recess of the suspender. The suspender has an elongate hole extending from its one narrow side to the other narrow side. The rear side wall of said hole is made a resilient arm by a transverse slot. The annular holder is clipped into a semi-cylindrical bearing disposed at the suspender.

2 Claims, 4 Drawing Figures

SHEATH FOR KNIFE WITH DEAD BLADE

BACKGROUND OF THE INVENTION

This invention relates to a sheath for a knife with a dead blade such as a hunting knife, a Bowie knife or the like, comprising a quiver, a suspender attached to the quiver and serving to push the sheath onto a body belt, and an annular retainer pivotted to the suspender, capable of being pushed over the handle of the knife and serving to secure the knife in the quiver.

Such sheaths are known. In the conventional sheaths, the quiver must be connected to the suspender, depending on the properties of the starting material, by sewing, rivetting, adhering or welding, and this is time-consuming and has as a result an increase of the production cost of the sheath. The retainer serving to secure the knife in the quiver of the sheath presently either consists of a small belt provided with a snap-button fastener or of a ring consisting of a flexible material. Both the small belt and the ring must likewise be attached to the suspender in a separate operation. A further disadvantage inherent to the conventional sheaths is that the sheath is not able to be pushed onto the body belt of the person who wishes to carry the knife without having opened the body belt before and having pulled it out of at least some of the belt loops of the trousers. The same applies in the event that the sheath is to be released from the body belt. It is furthermore considered to be a disadvantage of the conventional sheaths that the sheath cannot be stuck onto the body belt or trouser waist-band. This is desirous, however, in the event the knife is to be held quickly or only for a short while on the body belt or the clothing.

SUMMARY OF THE INVENTION

It is the object of this invention to simplify a sheath provided for a knife with a dead blade, of the initially set forth species, in relationship to the production thereof in such a way that the individual parts of the sheath made by using a plastic injection molding method are capable of being connected to one another in a simple way and that the suspender of the sheath is defined in such a way that the sheath is able to be pushed onto and pulled off, respectively, the body belt without opening the body belt before and is furthermore able to be stuck onto the body belt or the waist-band of the trousers of the person who desires to carry the knife.

To attain this object the present invention provides a sheath for a knife with a dead blade such as a hunting knife, a Bowie knife or the like, comprising a quiver, a suspender attached to the quiver and serving to push the sheath onto a body belt, and an annular retainer pivotted to the suspender, capable of being pushed over the handle of the knife and serving to secure the knife in the quiver, wherein the suspender of the sheath in the proximity of its lower end has an edged recess extending across the width of the suspender and a tongue adjacent thereto which is bevelled and defines the lower end of the suspender and the quiver of the sheath at the rear side has an edged U-shaped bridge integral with the quiver, said bridge being arrested with its web in the recess of the suspender, the suspender has an elongate hole extending from its one narrow side to the other narrow side, the rear side wall of said hole being made a resilient arm by a transverse slot, and the annular holder is clipped into a semi-cylindrical bearing disposed at the suspender.

The suspender is pushed with its tongue-like end so far underneath the bridge of the quiver for a connection to the quiver of the sheath that the bridge snaps into the recess of the suspender with its web as a result of the self-resiliency of the starting material. The two parts are thereafter reliably connected to one another. Since furthermore the annular retainer is capable of being snapped into the bearing disposed at the suspender likewise as a result of the self-resiliency of the starting material, the three parts of the sheath respectively produced independently may reliably be connected to one another by two simple manual operations. Furthermore, the sheath as a result of the flexible arm produced at the suspender is able to be hung to or removed from the body belt with the elongate hole of the suspender without before having to release the body belt from its closure. The sheath is furthermore capable of being clipped to the body belt or the waist-band of trousers by means of the resilient arm.

A further advantage of the sheath of this invention is that the resilient arm of the suspender of the sheath has pointed teeth projecting inwardly into the slot and the lower arm has pointed teeth projecting outwardly from near the slot opening.

The two pointed toothings substantially prevent an unintended detachment of the sheath from trousers when it is stuck onto the waist-band of such trousers, since the sheath grasps outwardly with the pointed toothing and inwardly into the trousers.

BRIEF DESCRIPTION OF THE DRAWING

An embodiment of the invention will now be described by way of example and with reference to the accompanying drawing, in which.

DESCRIPTION OF THE PREFERRED EMBODIMENT

Figure 1:
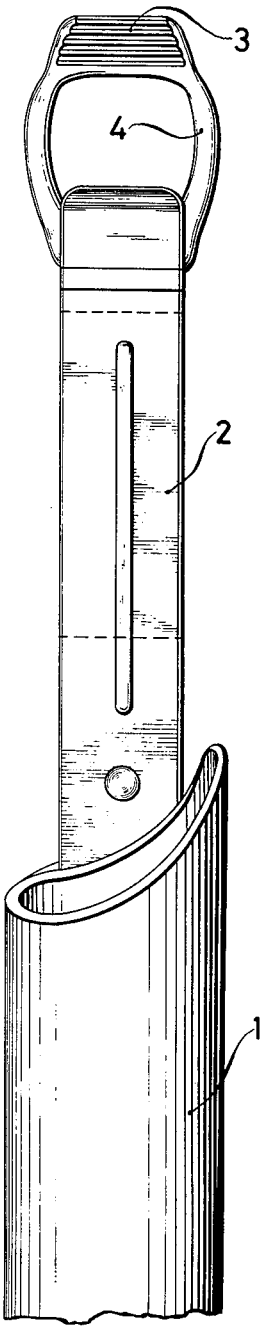
FIG. 1 is a fragmentary front elevational view of a sheath according to the invention.
Figure 2:
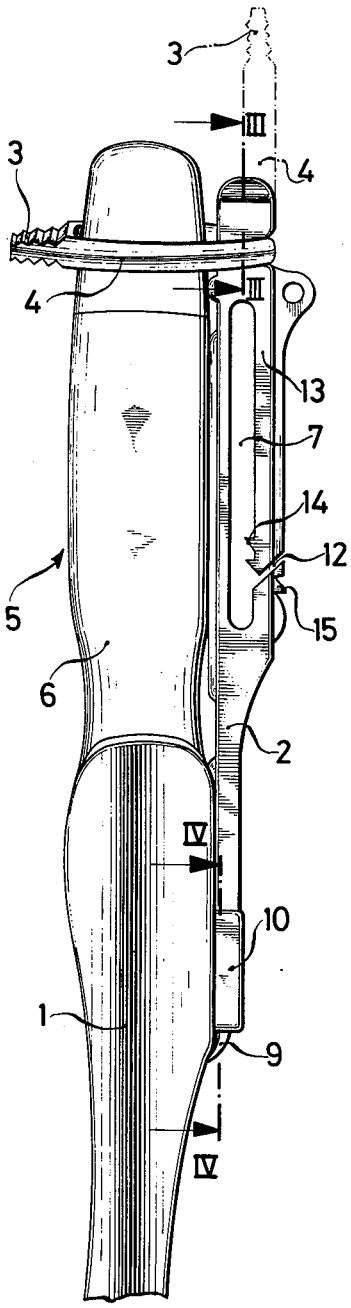
FIG. 2 is a side elevational view with a knife stuck into the quiver of the sheath.
Figure 3:
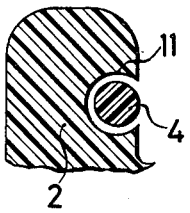
FIG. 3 is a cross-sectional view along the line III—III of FIG. 2.
Figure 4:
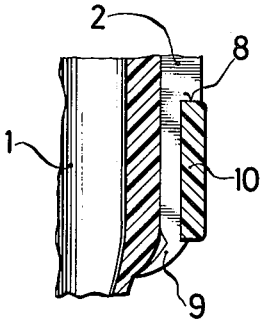
FIG. 4 is a cross-sectional view along the line IV—IV of FIG. 2.

FIGS. 1 and 2 show a sheath according to the invention which comprises a quiver 1, a suspender 2 and an annular retainer 4 provided with a manipulator 3. The reference numeral 5 denotes a knife inserted with its blade into the quiver 1, and the reference numeral 6 denotes the handle of the knife 5. The retainer 4 overlaps the handle 6 of the knife 5, as shown in FIG. 2, the knife 5 thereby being secured in the quiver 1 of the sheath. The suspender 2 has an elongate hole 7 which extends from the narrow side of the suspender 2 to the other narrow side thereof. The sheath may be pushed onto a body belt by means of the elongate hole 7. Quiver 1, suspender 2 and retainer 4 are each made alone in using a plastic injection-molding process.

The suspender 2 of the sheath has in the proximity of its lower end an edged recess 8 extending across the width thereof, adjacent to which there is provided a bevelled tongue 9 defining the lower end of the suspender 2. Furthermore, the quiver 1 at its rear side has an edged, U-shaped bridge 10 which is integral with the quiver 1. The suspender 2 is pushed underneath the bridge 10 for a connection to the quiver 1 so far that it has snapped into the recess 8 of the suspender 2 with its web. The retainer 4 is clipped into a semi-cylindrical notch or bearing 11 arranged at the upper end of the suspender 2. The rear-sided wall of the elongate hole 7 of the suspender 2 is formed into a resilient upper arm 13 and lower arm 16 defining a transverse slot 12. The arm 13 has forwardly pointed teeth 14. Pointed teeth 15 are provided extending rearwardly from the lower arm 16, the free end of which is disposed in front of the free end of the arm 13.

The invention may be embodied in other specific forms without departing from the spirit or essential characteristics thereof. The embodiment is therefore to be considered in all respects as illustrative and not restrictive.

What is claimed is:

1. A sheath for a kinfe with a dead blade such as a hunting knife, a Bowie knife or the like, comprising:

(a) a quiver for retaining the blade of a knife, (b) an elongated suspender secured to said quiver and arranged for attachment to a body belt, and (c) an annular retainer pivotally secured to said suspender and adapted to be pushed over the handle of said knife to secure said knife in said quiver, (d) said quiver including a U-shaped bridge at the rear side thereof, (e) said suspender being bevelled at one end thereof and including a recessed area extending across the width thereof adjacent said bevelled end whereby said suspender may be inserted between said U-shaped bridge and the rear side of said quiver and locked in position with said U-shaped bridge passing over said recessed area of said suspender.

(f) said suspender defining a notch therein adjacent the opposite end thereof for resiliently and pivotally securing said annular retainer, and (g) said suspender further including means defining an elongated slot between said recessed area and said notch for receiving said body belt, said means comprising an upper arm projecting downwardly substantially parallel to and spaced from said suspender and a lower arm projecting upwardly substantially parallel to and spaced from said suspender to define therebetween said slot.

2. A sheath as set forth in claim 1 wherein said upper and lower arms extend towards each other and the ends thereof are adjacent each other, the end of said upper arm includes a plurality of pointed teeth projecting in a forward direction and the end of said lower arm includes a plurality of teeth extending in a rearward direction.

* * * * *